United States Patent [19]

Levy

[11] 4,382,881

[45] May 10, 1983

[54] ANTISTATIC COATING AND ITS METHOD OF PREPARATION

[75] Inventor: Fernand J. Levy, Puteaux, France

[73] Assignee: Avions Marcel Dassault-Breguet Aviation, Vaucresson, France

[21] Appl. No.: 178,167

[22] Filed: Aug. 14, 1980

[30] Foreign Application Priority Data

Aug. 14, 1979 [FR] France ..... 79 20695

[51] Int. Cl.[3] ..... H01B 1/00

[52] U.S. Cl. ..... 252/500; 29/620; 174/137 A; 174/138 C; 174/140 C; 252/511; 260/DIG. 17; 361/218

[58] Field of Search ..... 361/212, 216, 218, 220; 343/873, 885; 174/137 A, 138 C, 140 C, 124 GC; 252/500, 501.1, 512, 511; 427/386, 389.8, 393.5; 428/417, 425.6, 922, 288, 28 9, 290, 224, 285; 260/DIG. 15, DIG. 16, DIG. 17, DIG. 21; 338/308; 29/620

[56] References Cited

U.S. PATENT DOCUMENTS 2,386,095 10/1945 Edgar et al. ..... 252/511 X
3,616,140 10/1971 Copeland et al. ..... 428/542 X
4,075,260 2/1978 Tsen et al. ..... 427/386 X
4,080,643 3/1978 Cline ..... 361/218
4,090,984 5/1978 Lin et al. ..... 252/511

FOREIGN PATENT DOCUMENTS 49-17833 2/1974 Japan ..... 252/511

*Primary Examiner*—Michael R. Lusignan
*Assistant Examiner*—Thurman K. Page
*Attorney, Agent, or Firm*—A. W. Breiner

[57] ABSTRACT

A method of preparing an antistatic coating exhibiting a desired value of surface resistivity which is substantially stable with respect to time takes as its starting point a commercial antistatic product having a synthetic resin base and substantially free from metallic particles but of which the surface resistivity, measured after mixing with its hardener and drying, is very much below the desired value. A compatible insulating resin is added to this product so as to raise the surface resistivity, still measured after mixing with the hardener and drying, to a value much higher than the desired value. The resulting product is then subjected to an accelerated ageing treatment causing a reduction in surface resistivity with terminal asymptotic development to the level of the desired value. Such a coating may be applied to radomes and other aircraft surface elements, and has the advantage that its conductivity does not increase appreciably with age.

4 Claims, No Drawings

ANTISTATIC COATING AND ITS METHOD OF PREPARATION

BACKGROUND OF THE INVENTION

This invention relates to an antistatic coating and its method of preparation.

The metal structure of modern aircraft, the speed and external surface area of which continue to increase, constitutes a conducting path allowing the flow of electrostatic charges generated by triboelectricity, the ionisation of gases thrown out by the engines and the generation of an electric field. However, non-conducting elements, such as hatches, miscellaneous fairings and radomes, consisting of layers of insulating synthetic fibres coated with resin and then polymerised, resist this flow by encouraging the accumulation of electrostatic charges on their surfaces. The same is true of metal surfaces coated with insulating paint, since the paint acts as a very thin non-conducting element.

Charges building up on the surfaces of these non-conducting elements raise the latter to a potential different from that of the aircraft's metal structure. This difference in potential increases more or less rapidly until it reaches the breakdown voltage. A series of discharges then takes place, the electrical energy of which interferes with the correct functioning of equipment carried on board by generating radio-electrical interference. This process is accelerated and amplified by bad weather.

In order to alleviate this interference, which may considerably attenuate the quality of navigational aids and reduce the efficiency of telecommunication means, one must endeavour to render the surface of aircraft equipotential by means of coatings capable of rendering these insulating surfaces conducting or antistatic.

However, there are non-metallic elements distributed on the surface of aircraft, particularly radomes protecting the antennae, which cannot be made too conductive under penalty of making them opaque to electromagnetic radiation by modifying their radio-electrical transparency.

In the case of these radomes, therefore, a paint must be used which, although a conductor, is free from metal particles the distributing power of which is considerable. Such a non-metallic paint must allow the flow of static charges and exhibit a surface resistivity which is proportioned judiciously so as not to modify the radio-electrical transparency of the radome.

Furthermore, once it has hardened this paint should retain its characteristics virtually permanently since, generally speaking, the natural aging of such coatings tends to make them more conducting with the result that these coatings tend to become more conductive than is desirable after prolonged use. They would then interfere with, instead of improving, the good functioning of the antenna protected by the radome.

Studies carried out by the applicants in this field have resulted in a precise definition of the desired value of the surface resistivity of coatings applicable to radomes and similar surface elements. This surface resistivity, measured by the standard US-MIL-C-7439 and expressed as "ohms per square", must be, for maximum efficiency, between 5 and 100 megohms per square and be stabilised at that value.

However, it is found that such a stabilisation of surface resistivity is extremely difficult to obtain since, as has been said, commercial antistatic coatings have a tendency to become more and more conductive in the course of time. It follows, on the one hand, that a coating which is initially too conducting would scarcely improve with time, while, on the other hand, a coating which is initially too insulating would tend, on aging, to attain the correct resistivity at a certain moment before becoming in its turn too conducting. Obviously, it is not possible to make the best of such products.

SUMMARY OF THE INVENTION

The invention provides a method of preparing an antistatic coating exhibiting a desired value of surface resistivity which is substantially stable with respect to time, comprising selecting an antistatic starting product having a synthetic resin base substantially free from metal particles but of which the surface resistivity, measured after mixing with its hardener and drying, is below the desired value, adding a compatible insulating resin to the product so as to raise the surface resistivity, still measured after mixing with the hardener and drying, to a value higher than the desired value, and subjecting the resulting product to an accelerated ageing treatment causing a reduction in surface resistivity with terminal asymptotic development to the level of the desired value.

The treatment in question is preferably a heat treatment, such as stoving for some hours at a temperature of the order of 90° C.

DESCRIPTION OF THE PREFERRED OPERATIONS

By way of example, two methods in accordance with the invention will be described herein below, starting from commercial chemical products in the field of antistatic coatings.

EXAMPLE 1

The starting point is a product based on polyurethane resin, manufactured in France by PYROLAC and sold together with its hardener under the trade mark "Pyroflex". More exactly, it is a variant of Pyroflex with reference number 7D713-A171 and prepared with very fine acetylene black powder suitable for improving its surface condition in view of its use as a coating on aircraft.

This product should normally be mixed with its hardener, Pyroflex 0651, in the following proportions in ponderal parts (p.p.):

Pyroflex black conductive paint 7D713-A171: 100 p.p.

Pyroflex hardener 0651: 34 p.p.

After drying for 24 hours at ambient temperature, its surface resistivity is 0.005 megohm per square, a value which is 1000 times less than the minimum of 5 megohms per square required.

The product Pyroflex 7D713-A171 is appreciably modified by adding a significant proportion, for example approximately a half, of compatible, insulating resin, in this case the colourless, insulating polyurethane varnish which serves as a base for Pyroflex 7D713 paint (at 52% dry extract). The formula retained after systematic tests is as follows:

Pyroflex black conducting paint 7D713-A171: 100 p.p.

Colourless, insulating polyurethane varnish serving as a base for Pyroflex paint 7D713: 50 p.p.

Pyroflex hardener 0651: 65 p.p.

After drying for 24 hours at ambient temperature, the surface resistivity of the coating obtained is of the order of $10^4$ megohms per square.

After a heat treatment of some hours at 90° C. in a ventilated stove, the coating attains a quasi-asymptotic value of between 5 and 100 megohms per square for dry coating thicknesses of between 15 and 80 microns (unusual thinnesses in aeronautics corresponding to a valuable gain in weight).

EXAMPLE 2

The starting point is a product based on an epoxy resin manufactured in the United States by the DE SOTO Company and sold as an antistatic paint under the description "Super Koropon Antistatic Coating Black 528×306" with its hardener "Activator 910×464".

The mixture is normally made in the following proportions:

Super Koropon Antistatic Coating Black 528×306: 100 p.p.

Activator 910×464: 80 p.p.

A coating is obtained having a surface resistivity of 0.6 megohm per square after drying for 24 hours at ambient temperature for dry coating thicknesses between 15 and 80 microns.

This surface resistivity being very much below the required minimum of 5 megohms per square, the product is modified by the addition of "Clear Coating 520-015" insulating epoxy resin manufactured by DE SOTO and a quantity of hardener (activator 910×464) adapted to the new mixing proportions.

The formula retained following systematic tests is as follows:

Super Koropon Antistatic Coating Black 528×306: 100 p.p.

32% dry extract insulating epoxy varnish, Clear Coating 520-015: 20 p.p.

Activator 910×464: 96 p.p.

The surface resistivity of this coating, which is above $10^4$ megohms per square after drying for 24 hours at the ambient temperature, reaches a quasi-asymptotic value of between 5 and 100 megohms per square after stoving for some hours at 90° C., for coating thicknesses between 15 and 80 microns.

It will be noted that in the examples described (polyurethane paint and epoxy paint) the very large quantity of insulating varnish added to the paints considerably modifies their initial surface resistivity and allows coatings which are virtually insulating to be obtained at an intermediate stage (surface resistivity of the order of $10^4$ megohms per square) which, after a moderate heat treatment corresponding to a natural ageing of some years, becomes stabilised at a value between 5 and 100 megohms per square for coating thicknesses of 15 to 80 microns.

It goes without saying that these antistatic coatings, which are particularly well adapted to the flow of electrostatic charges on radomes (antenna protectors), are just as suitable for protecting other non-conducting elements distributed on the surface of aircraft. They are to be recommended as generalised aircraft coatings for the purpose of rendering the aircraft surface equipotential.

I claim:

1. A method of preparation of an antistatic coating composition designed for use on external surface portions of an aircraft and exhibiting a timewise-stable surface resistivity, for a coating thickness of between about 15 microns and about 80 microns, which is low enough to preclude the building up of electric charges on said aircraft portions while being not so low as to become an effective radio-electric shield, comprising the steps of:

(i) selecting a conductive synthetic resin free of metal particles and exhibiting, after curing, a surface resistivity which is far below a predetermined minimum value of 5 megohms per square, (ii) mixing therewith a compatible insulating resin in such proportion that the resin mixture exhibits, after curing, a surface resistivity which is far above a predetermined maximum value of 100 megohms per square, and (iii) subjecting said resin mixture to an accelerated aging treatment resulting in a progressive reduction in surface resistivity tending asymptotically towards a value intermediate said predetermined minimum and maximum values, whereby a final composition is obtained which exhibits a timewise-stable surface resistivity lying within a range of from 5 to 100 megohms per square for a coating thickness of between about 15 and about 80 microns.

2. Method as claimed in claim 1, wherein said conductive synthetic resin free of metal particles is a black paint, and said compatible insulating resin is a clear or colorless varnish.

3. Method as claimed in claim 2, wherein both said black paint and said clear or colorless varnish are selected from the group comprising polyurethane and epoxy resins, and wherein the resin mixture is dried for 24 hours at ambient temperature before being subjected to accelerated aging treatment which comprises stoving the dried resin mixture at a temperature of the order of 90° C.

4. An antistatic coating composition designed for use on external surface portions of an aircraft and exhibiting a timewise-stable surface resistivity, for a coating thickness of between about 15 microns and about 80 microns, which is low enough to preclude the building up of electric charges on said aircraft portions while being not so low as to become an effective radio-electric shield, comprising a mixture of a conductive synthetic resin component which is a black paint free of metal particles and of a compatible insulating resin component which is a clear or colorless varnish, both components being selected from the group comprising polyurethane and epoxy resins, said coating composition exhibiting a timewise-stable surface resistivity lying within a range of from 5 to 100 megohms per square for a coating thickness of between about 15 and about 80 microns.

* * * * *